US009017118B1

(12) United States Patent
Pfiffner et al.

(10) Patent No.: US 9,017,118 B1
(45) Date of Patent: Apr. 28, 2015

(54) GEAR CASE ASSEMBLY FOR A MARINE OUTBOARD ENGINE AND METHOD OF ASSEMBLY THEREOF

(71) Applicant: BRP US Inc., Sturtevant, WI (US)

(72) Inventors: Simon Pfiffner, Deerfield, IL (US); Michael Freitag, Kenosha, WI (US)

(73) Assignee: BRP US Inc., Sturtevant, WI (US)

( * ) Notice: Subject to any disclaimer, the term of this patent is extended or adjusted under 35 U.S.C. 154(b) by 176 days.

(21) Appl. No.: 13/755,605

(22) Filed: Jan. 31, 2013

Related U.S. Application Data

(60) Provisional application No. 61/592,929, filed on Jan. 31, 2012.

(51) Int. Cl.
*B63H 23/00* (2006.01)
*B63H 20/14* (2006.01)

(52) U.S. Cl.
CPC ..... *B63H 20/14* (2013.01)

(58) Field of Classification Search
USPC ..... 440/75
IPC ..... B63H 23/02
See application file for complete search history.

(56) References Cited

U.S. PATENT DOCUMENTS

| | | | | |
|---|---|---|---|---|
| 3,467,051 | A | 9/1969 | Shimanckas | |
| 3,623,583 | A | 11/1971 | Shimanckas | |
| 3,919,964 | A | 11/1975 | Hagen | |
| 4,323,356 | A | 4/1982 | Stephenson | |
| 4,530,667 | A | 7/1985 | McCormick | |
| 4,575,310 | A | 3/1986 | Otani | |
| 4,668,198 | A | 5/1987 | Nakamura | |
| 4,820,210 | A | 4/1989 | Dretzka | |
| 4,863,290 | A | 9/1989 | McNeill et al. | |
| 5,059,144 | A | 10/1991 | Onoue | |
| 5,151,059 | A | 9/1992 | Higby | |
| 5,252,028 | A | 10/1993 | LoBosco et al. | |
| 5,820,425 | A | 10/1998 | Ogino et al. | |
| 6,022,251 | A | 2/2000 | Ogino | |
| 6,217,400 | B1 | 4/2001 | Natsume | |
| 6,346,017 | B1 | 2/2002 | Silorey et al. | |
| 6,383,042 | B1 | 5/2002 | Neisen | |
| 6,517,395 | B1 | 2/2003 | Higby et al. | |
| 6,547,613 | B1 | 4/2003 | Onoue et al. | |
| 6,835,109 | B2 | 12/2004 | Takada et al. | |
| 7,086,836 | B1 | 8/2006 | Sheth et al. | |
| 7,153,174 | B2 | 12/2006 | Takada et al. | |
| 7,334,501 | B2 | 2/2008 | Ide et al. | |
| 7,958,722 | B2 * | 6/2011 | Komiyama et al. | 60/289 |
| 8,419,489 | B2 | 4/2013 | Tsunekawa et al. | |
| 2010/0167604 | A1 | 7/2010 | Inaba | |
| 2010/0173543 | A1 | 7/2010 | Inaba | |

* cited by examiner

*Primary Examiner* — Stephen Avila
(74) *Attorney, Agent, or Firm* — BCF LLP

(57) ABSTRACT

The gear case assembly has a gear case, a driveshaft and a propeller shaft mounted at an angle to the driveshaft, each at least partly disposed within the gear case, a transmission having forward and reverse gears and a shift rod, and an electric transmission actuator assembly having an actuation axis and an actuator end engaging the shift rod. The transmission is operatively connected the propeller shaft and the driveshaft selectively drives the propeller shaft via the transmission. An actuator chamber houses at least part of the actuator assembly. There is a gap between the actuator assembly and an actuator chamber wall in a direction perpendicular to the actuation axis. The gap is sized and shaped to permit a translation of the actuator assembly away from the shift rod for disengagement from the shift rod. A gear case, a marine outboard engine and a method of assembly is also disclosed.

21 Claims, 8 Drawing Sheets

GEAR CASE ASSEMBLY FOR A MARINE OUTBOARD ENGINE AND METHOD OF ASSEMBLY THEREOF

CROSS REFERENCE

The present application claims priority to U.S. Provisional Patent Application No. 61/592,929, filed Jan. 31, 2012, the entirety of which is incorporated herein by reference.

FIELD OF THE INVENTION

The present invention relates to a gear case assembly. More specifically, the present invention relates to a gear case assembly to be used in a marine outboard engine.

BACKGROUND

The propellers of many marine outboard engines can be operated in two opposite directions of rotation resulting in forward or reverse motion of the watercraft. The propeller is mounted on a propeller shaft and operated by rotation of the propeller shaft by a rotating driveshaft extending from the engine. The propeller shaft is attached to a transmission that converts rotation of the vertically oriented driveshaft to rotation of the horizontally disposed propeller shaft.

A linear or rotary actuator is used to selectively actuate the transmission thereby placing the propeller shaft in forward, reverse or neutral operating conditions. Whether actuated with a linear actuator or a rotary actuator, the actuator is typically mounted in the midsection or the powerhead and a vertical coupling rod extending down from the actuator through the midsection couples the actuator with the transmission for actuation of the transmission.

Marine outboard engines are often provided in different lengths of midsections. This necessitates the use of different lengths of coupling rods, and therefore complicates the manufacture of outboard engines as different gear cases have to be used for each model with a particular length of midsection. Thus, there is a need for a gear case assembly for a marine outboard engine that can be used with outboard engine models having different midsection lengths.

In addition, the process of assembling a gear case assembly entailing the installation of a multitude of interconnected components installed within the tightly confined spaces of the gear case can be a complicated task. There is thus also a need for a gear case that can be assembled and disassembled easily.

SUMMARY

It is an object to ameliorate at least some of the inconveniences present in the prior art.

In one aspect, the present provides a gear case assembly for a marine outboard engine having a gear case, a driveshaft partly disposed within the gear case, and a propeller shaft disposed at least in part within the gear case and at an angle to the driveshaft. A transmission, having forward and reverse gears and a shift rod and operatively connected to the propeller shaft is included in the gear case. The lower section of the driveshaft selectively drives the propeller shaft via the transmission. The shift rod is selectively actuated for the selective driving of the propeller shaft. An electric transmission actuator assembly included in the gear case selectively actuates the shift rod. The electric transmission actuator assembly has an actuation axis and an actuator end. The actuator end engages an end of the shift rod. The gear case also has an actuator chamber which houses at least part of the electric transmission actuator assembly. A gap is defined between the electric transmission actuator assembly and a wall of the actuator chamber. The gap extends in a direction perpendicular to the actuation axis. The gap is sized and shaped to permit a translation of the electric transmission actuator assembly in the direction perpendicular to the actuation axis away from the shift rod and thereby enable the disengagement of the actuator end from the end of the shift rod.

In a further aspect, a dimension of the gap is at least a third of a dimension of the end of the shift rod in the direction perpendicular to the actuation axis.

In another aspect, the gear case has a transmission chamber housing at least a part of the propeller shaft and the transmission.

In yet another aspect, the gear case has a driveshaft chamber housing the part of the driveshaft.

In a further aspect, the shift rod extends into the actuator chamber via a passage extending between the actuation chamber and the transmission chamber.

In an additional aspect, the passage seals around the shift rod as it extends therethrough.

In another aspect, the actuator chamber has a projection extending from a wall of the actuator chamber towards the actuation axis. A surface of the electric transmission actuator assembly abuts a surface of the projection. The projection is disposed between the surface of the electric transmission actuator assembly and the transmission chamber.

In a further aspect, the gear case also includes a water channel in proximity to the actuator chamber.

In an additional aspect, the water channel is disposed along three sides of the actuator chamber.

In yet another aspect, the gear case has an actuator cap closing an open end of the actuator chamber.

In a further aspect, the actuator cap has at least one cable opening and at least one electrical cable of the electric transmission actuator assembly passes through the at least one cable opening.

In another aspect, the actuator cap has a recess. A portion of the electric transmission actuator assembly is received in the recess.

In yet another aspect, the actuator cap engages the electric transmission actuator assembly and thereby fixes the position of the electric transmission actuator assembly within the actuator chamber.

In a further aspect, the actuation axis is parallel to the driveshaft.

In an additional aspect, the actuation axis is parallel to the driveshaft.

In another aspect, the actuator is a linear actuator.

In yet another aspect, one of the actuator end and an end of the shift rod has a male end and an other of the actuator end and the end of the shift rod has a female end in mutual engagement.

In a further aspect, the male end comprises a disc and the female end comprises a slot. At least a portion of the disc is received in the slot, the portion of the disc being disposed between portions of the female end at least in a direction parallel to the actuation axis.

In an additional aspect, the electric transmission actuator assembly includes an actuator and an electric motor.

In another aspect, a marine outboard engine is provided. The marine outboard engine has a cowling and an engine disposed in the cowling. A driveshaft is also disposed in the cowling. The driveshaft has at least an upper section and a lower section. The upper section of the driveshaft is operatively connected to the engine. The marine outboard engine has a midsection having a first end and a second end. The first end of the midsection is connected to the engine. A gear case operatively connected to the second end of the midsection is also included in the marine outboard engine. A propeller shaft disposed at an angle to the driveshaft and a transmission having forward and reverse gears and a shift rod is also included in the marine outboard engine. The transmission is operatively connected to the propeller shaft. The lower section of the drive shaft selectively drives the propeller shaft via the transmission. The shift rod is selectively actuated for the selective driving of the propeller shaft. The marine outboard engine also includes an electric transmission actuator assembly selectively actuating the shift rod. The electric transmission actuator assembly has an actuation axis and an actuator end. The actuator end engages an end of the shift rod. A bladed rotor connected to the propeller shaft is included in the engine. At least a part of the propeller shaft and the driveshaft are disposed within the gear case. The gear case has an actuator chamber housing at least part of the electric transmission actuator assembly. A gap is defined between the electric transmission actuator assembly and a wall of the actuator chamber. The gap extends in a direction perpendicular to the actuation axis to permit a translation of the electric transmission actuator assembly in the direction perpendicular to the actuation axis away from the shift rod and thereby enable the disengagement of the actuator end from the end of the shift rod.

In a further aspect, a dimension of the gap between the electric transmission actuator assembly and a wall of the actuator chamber in a direction perpendicular to the actuation axis is at least a third of a dimension of the end of the shift rod in the direction perpendicular to the actuation axis.

In another aspect, the gear case of the marine outboard engine has a driveshaft chamber housing at least a part of the driveshaft.

In an additional aspect, the gear case has a transmission chamber housing at least a part of the propeller shaft and the transmission. The shift rod extends into the actuator chamber via a passage extending between the actuator chamber and the transmission chamber.

In another aspect, the passage seals around the shift rod as the shift rod extends through the passage.

In a further aspect, the electric transmission actuator assembly of the marine outboard engine includes an actuator and an electric motor.

In an additional aspect, the present also provides a method of assembling an electric transmission actuator assembly in a gear case assembly. The gear case assembly has a gear case having an actuator chamber for housing the electric transmission actuator assembly, a transmission and a transmission chamber for housing at least a part of the transmission. The transmission has a shift rod extending from the transmission chamber into the actuator chamber. The electrical transmission actuator assembly has an actuator end. The method comprises: inserting the electrical transmission actuator assembly into the actuator chamber along a first direction until the actuator end is aligned with an end of the shift rod in the first direction and the actuator end is spaced apart from the end of the shift rod in a second direction perpendicular to the first direction; and translating the electric transmission actuator assembly in the second direction towards the end of the shift rod so as to engage the actuator end with the end of the shift rod.

In yet another aspect, the method further comprises translating the electric transmission actuator assembly towards the shift rod until a surface of the electric transmission actuator assembly rests upon a surface of a projection, the projection extending from a wall of the actuator chamber in a direction perpendicular to the first direction thereby supporting the electric transmission actuator assembly on the projection and aligning the actuator end with the end of the shift rod in the first direction.

In an additional aspect, the method further comprises placing an actuator cap to the gear case after engaging the actuator end with the end of the shift rod to close an opening of the actuator chamber, the opening being the opening through which the electric transmission actuator assembly is inserted into the actuator chamber, and securing the actuator cap to the gear case.

In an yet another aspect, the actuator cap engages the electric transmission actuator assembly and the method further comprises the step of securing the actuator cap to the gear case fixes the position of the electric transmission actuator assembly within the actuator chamber.

In an additional aspect, a gear case for a marine outboard engine is provided. The gear case includes a transmission chamber for housing a transmission and at least a part of a propeller shaft to be disposed at an angle to a driveshaft. An actuator chamber for housing a electric transmission actuator assembly is also included in the gear case. The actuator chamber and the transmission chamber are connected by a passage adapted for receiving a shift rod which passes from the transmission chamber into the actuator chamber. The passage has a central axis and the actuator chamber has a projection extending towards the central axis from a wall of the actuator chamber.

For purposes of the present application, terms related to spatial orientation when referring to a marine outboard engine and components in relation to the marine outboard engine, such as "front", "rear", "left", "right", "above" and "below", are as they would be understood by a driver of a boat to which the marine outboard engine is connected, with the marine outboard engine connected to the stern of the boat, in a straight ahead orientation (i.e. not steered left or right), and in an upright position (i.e. not tilted and not trimmed).

Embodiments of the present invention each have at least one of the above-mentioned object and/or aspects, but do not necessarily have all of them. It should be understood that some aspects of the present invention that have resulted from attempting to attain the above-mentioned object may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
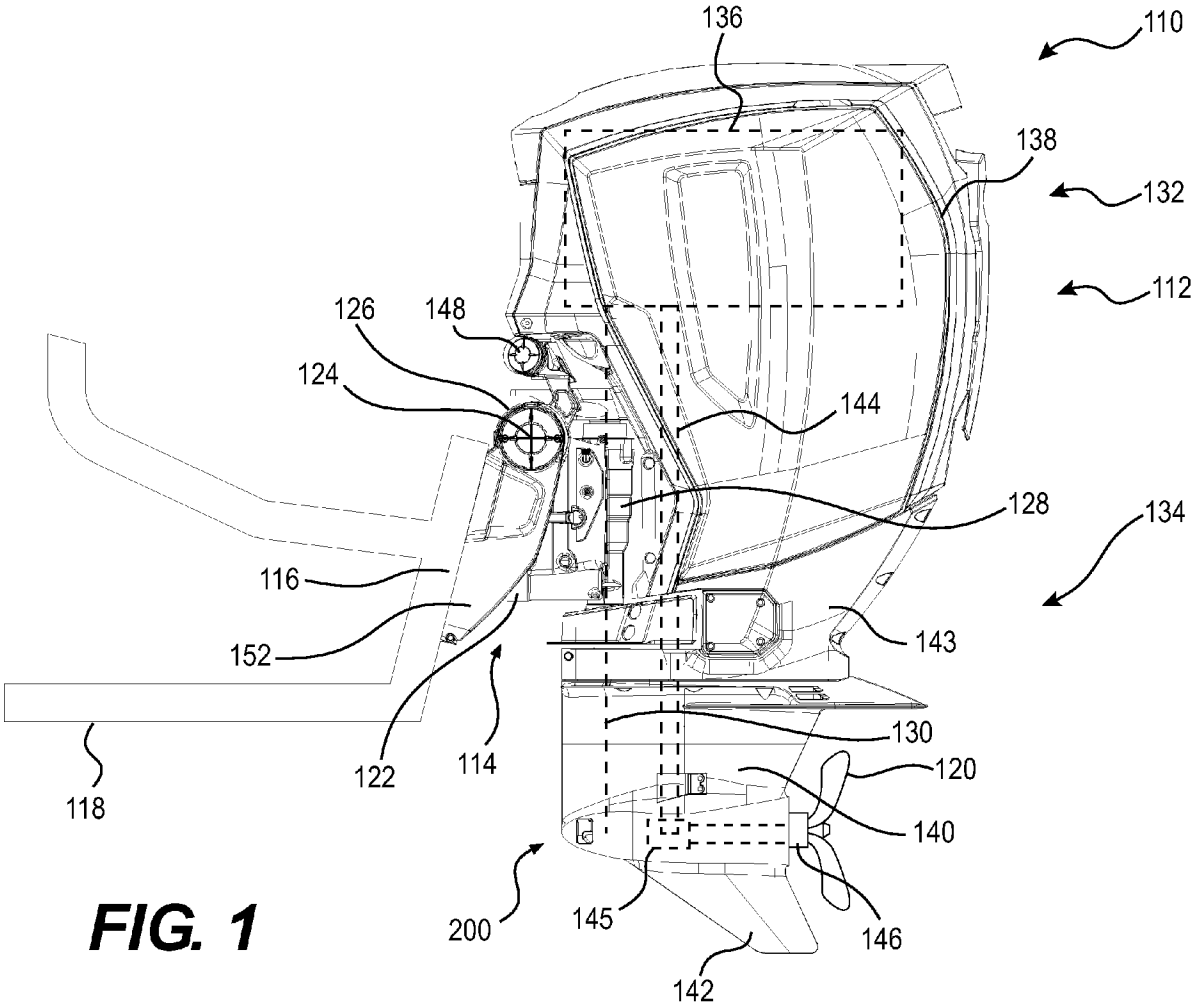
FIG. 1 is a left side elevation view of a marine outboard engine mounted to a stern of a boat.

With reference to FIG. 1, a marine outboard engine 100, shown in the upright position, includes a drive unit 112 and a bracket assembly 114. The bracket assembly 114 supports the drive unit 112 on a transom 116 of a hull 118 of an associated watercraft (not shown) such that a propeller 120 is in a submerged position with the watercraft resting relative to a surface of a body of water. The drive unit 112 can be trimmed up or down relative to the hull 118 by linear actuators 122 of the bracket assembly 114 about a tilt/trim axis 124 extending generally horizontally. The drive unit 112 can also be tilted up or down relative to the hull 118 by a rotary actuator 126 of the bracket assembly 114 about the tilt/trim axis 124. The drive unit 112 can also be steered left or right relative to the hull 118 by another rotary actuator 128 of the bracket assembly 114 about a steering axis 130. The steering axis 130 extends generally perpendicularly to the tilt/trim axis 124. When the drive unit 112 is in the upright position as shown in FIG. 1, the steering axis 130 extends generally vertically.

The drive unit 112 includes an upper portion 132 and a lower portion 134. The upper portion 132 includes an engine 136 (schematically shown in dotted lines) surrounded and protected by a cowling 138. The engine 136 housed within the cowling 138 is an internal combustion engine, such as a two-stroke or four-stroke engine, having cylinders extending generally horizontally when the drive unit 112 is in an upright position as shown. It is contemplated that other types of engines could be used and that the cylinders could be oriented differently. The lower portion 134 includes the gear case assembly 200, which includes a gear case 140, the propeller 120, and the skeg portion 142. A midsection 143 is connected between the engine 136 and the gear case 140. It is contemplated that the midsection 143 could house a portion of an exhaust system of the outboard engine 100.

The engine 136 is coupled to a driveshaft 144 (schematically shown in dotted lines). When the drive unit 112 is in the upright position, the driveshaft 144 is oriented vertically. It is contemplated that the driveshaft 144 could be oriented differently relative to the engine 136. The driveshaft 144 is disposed in the cowling 138, passes through the midsection 143 and is coupled to a drive mechanism, which includes a transmission 145 and the propeller 120 mounted on a propeller shaft 146 as will be discussed in greater detail below. It is contemplated that the driveshaft 144 could not pass through the midsection 143. In FIG. 1, the propeller shaft 146 is perpendicular to the driveshaft 144, however it is contemplated that it could be at other angles. The driveshaft 144 and the transmission 145 transfer the power of the engine 136 to the propeller 120 mounted on the rear side of the gear case 140 of the drive unit 112. It is contemplated that the propulsion system of the outboard engine 100 could alternatively include a jet propulsion device, turbine or other known propelling device. It is further contemplated that the bladed rotor could alternatively be an impeller.

To facilitate the installation of the outboard engine 100 on the watercraft, the outboard engine 100 is provided with a connection box 148. The connection box 148 is connected on top of the rotary actuator 126. As a result, the connection box 148 pivots about the tilt/trim axis 124 when the drive unit 112 is tilted, but does not pivot about the steering axis 130 when the drive unit 112 is steered. It is contemplated that the connection box 148 could be mounted elsewhere on the bracket assembly 114 or on the drive unit 112. Devices located inside the cowling 138 which need to be connected to other devices disposed externally of the outboard engine 100, such as on the deck or hull 118 of the watercraft, are provided with lines which extend inside the connection box 148. Similarly, the corresponding devices disposed externally of the outboard engine 100 are also provided with lines that extend inside the connection box 148 where they are connected with their corresponding lines from the outboard engine 100. It is contemplated that one or more lines could be connected between one or more devices located inside the cowling 138 to one or more devices located externally of the outboard engine 100 and simply pass through the connection box 148. It is contemplated that the connection box 148 could be omitted.

Other known components of an engine assembly are included within the cowling 138, such as a starter motor, an alternator and the exhaust system. As it is believed that these components would be readily recognized by one of ordinary skill in the art, further explanation and description of these components will not be provided herein.

The gear case assembly 200 will now be described in more detail with reference to FIGS. 2 and 3. The gear case assembly 200 is shown in the figures in its upright position which is shown in FIG. 1. The gear case assembly 200 includes the gear case 140 housing portions of the driveshaft 144, the propeller shaft 146, the transmission 145 and an electric transmission actuator assembly 202. A portion of the lower section of the driveshaft 144 is mounted vertically near a longitudinal center of the gear case 140 with the engine in an upright position as shown in the figures. The propeller shaft 146 is mounted in an orientation perpendicular to the driveshaft 144 and is selectively connected to the transmission 145 which is also coupled to the bottom of the driveshaft 144. As mentioned above, the propeller 120 is connected to the rear end of the propeller shaft 146.

Two oppositely facing bevel gears 147*a,b* on the transmission 145 are engaged to opposite sides of a complementary bevel gear 149 at the bottom of the lower section of the driveshaft 144 and rotate with the driveshaft 144 but in opposite directions. Each beveled gear 147*a,b* of the transmission 145 has a toothed jaw, the two jaws being inwardly and oppositely facing. The propeller shaft 146 is in splined connection with a sleeve 162 having a pair of outwardly and oppositely facing toothed jaws. The outwardly facing toothed jaws of the sleeve 162 are selectively engaged with an adjacent inwardly facing toothed jaw of the bevel gears 147*a,b* by translation of the sleeve 162 along the propeller shaft 146. Engagement of the sleeve 162 with a bevel gear 147*a,b* on either side results in rotation of the propeller shaft 146 along with that bevel gear 147*a* or 147*b* corresponding to forward or reverse rotation of the propeller shaft 146. The sleeve 162 being in a position in the middle disengaged from both bevel gears 147*a,b* corresponds to a neutral operating condition of the gear case assembly 200 with no rotation of the propeller shaft 146.

A shift rod 212 is selectively actuated along its axis 215 to selectively actuate the sleeve 162. The vertically extending shift rod 212 is connected to one arm of an L-shaped rocker 164, with the other arm of the L-shaped rocker 164 being connected to a horizontal shaft 166 disposed within a bore defined along the forward end of the propeller shaft 146. The shaft 166 is connected to the sleeve 162 via a pin 168 extending through the rear end of the shaft 166, a slot in the propeller shaft 146 and the sleeve 162. When the shift rod 212 is pulled upwards, the rocker 164 is pushed up pulling forward (towards the left in the figure) the shaft 166 which in turn pulls the sleeve 162 towards the left thereby engaging the left bevel gear 147*a* of the transmission 145, and conversely, when the shift rod 212 is pushed downwards, the rocker 164 is pushed down pushing the shaft 166 away towards the rear (towards the right in the figure) which pushes the sleeve 162 towards the right thereby engaging the right bevel gear 147*b* of the transmission 145.

An electric transmission actuator assembly 202 is included in the gear case 140 to actuate the vertically extending shift rod 212. The electric transmission actuator assembly 202 has an electric motor 206 connected to an actuator 204 extending vertically downwards. The actuator 204 is actuated along an actuation axis 209 coinciding with a central axis of the actuator 204, and the actuation is controlled by providing appropriate logic signals to the electric motor 206. The actuator 204 has an actuator end 208 engaging an end 214 of the shift rod 212. The actuator 204 actuates the sleeve 162 by actuating the shift rod 212 vertically along a central axis 215 of the shift rod. The actuator axis 209 is parallel to the driveshaft 144, however, it is contemplated that the actuation axis 209 can be at an angle to the driveshaft 144.

The actuator 204 shown is a linear actuator, however, it is contemplated that the actuator 204 can be a rotary actuator rotating about the actuation axis 209. Other configurations of the transmission 145 with different shifting mechanisms that can be actuated by a linear or rotary actuator to be in forward, reverse or neutral operating configurations of the gear case assembly are also contemplated.

The front of the electric transmission actuator assembly 202 is spaced apart from a wall 246 of the gear case 140 by a gap 232 in a direction perpendicular to the actuation axis 209. The gap 232 permits translation of the actuator assembly 202 along this direction towards or away from the shift rod 212 prior to or after engagement of the actuator end 208 with the end 214 of the shift rod 212. As will be discussed in further detail in conjunction with FIGS. 4A-4D, this gap permits a simplified assembling and disassembling of the gear case assembly.

The gap 232 between the wall 246 and the actuator assembly 202 has a minimum dimension that is approximately two-thirds the dimension of the end 214 of the shift rod 212, however it is contemplated that the gap 232 can have any dimension necessary to permit translation of the actuator assembly 202 from a position where the actuator end 208 is engaged with the end 214 of the shift rod 212 to a position where the actuator end 208 is disengaged with the end 214 of the shift rod 212, and vice versa. For the actuator and shift rod structures shown, the gap 232 would have a dimension at least equal to the overlap between the actuator end 208 and end of the shift rod 214 in the direction perpendicular to the actuation axis 209. For example, the gap 232 could have a minimum dimension equal to one third of the diameter of the end 214 of the shift rod 212 if one third or less of the end 214 of the shift rod 212 overlaps with the actuator end 208 when engaged.

The electric transmission actuator assembly 202 is housed in an actuator chamber 230. A portion of the propeller shaft 146 that is coupled to the sleeve 162 and the transmission 145 are housed in a transmission chamber 210 and a portion of the lower section of the driveshaft 144 is housed in a driveshaft chamber 220. The transmission chamber 210 and the driveshaft chamber 220 are in fluid communication having oil passing through the chambers to lubricate the moving parts such as the bevel gears 147*a,b* and the sleeve 162. The shift rod 212 of the transmission 145 extends from the transmission chamber 210 into the actuator chamber 230 through an opening or passage 234 between the two chambers. The passage 234 is sealed by a seal 235 to prevent entry of oil and other fluids from the transmission chamber 210 into the actuator chamber 230. The remaining portion of the propeller shaft 146 that is not coupled to any part of the transmission 145 is housed in a separate portion of the propeller shaft chamber sealed from the transmission chamber 210. It is contemplated that the portion of the lower section of the driveshaft 144 coupled to the transmission 145 is housed in the same chamber as the transmission 145 and the portion of the propeller shaft 146 coupled to the transmission.

Figure 2:
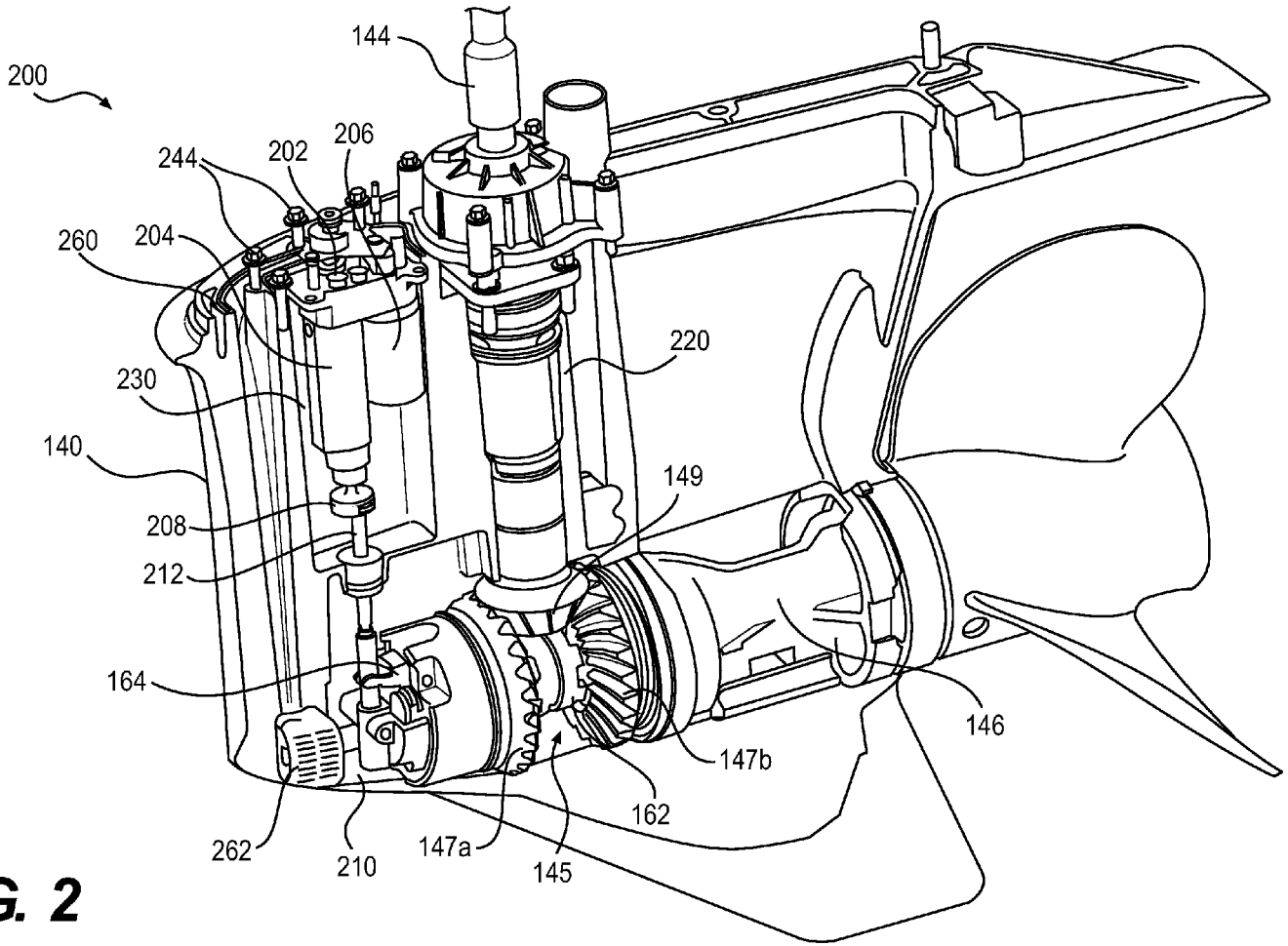
FIG. 2 is a cutaway perspective view of a portion of the gear case assembly of the marine outboard engine of FIG. 1 with the actuator assembly moved out of the actuator chamber.
Figure 3:
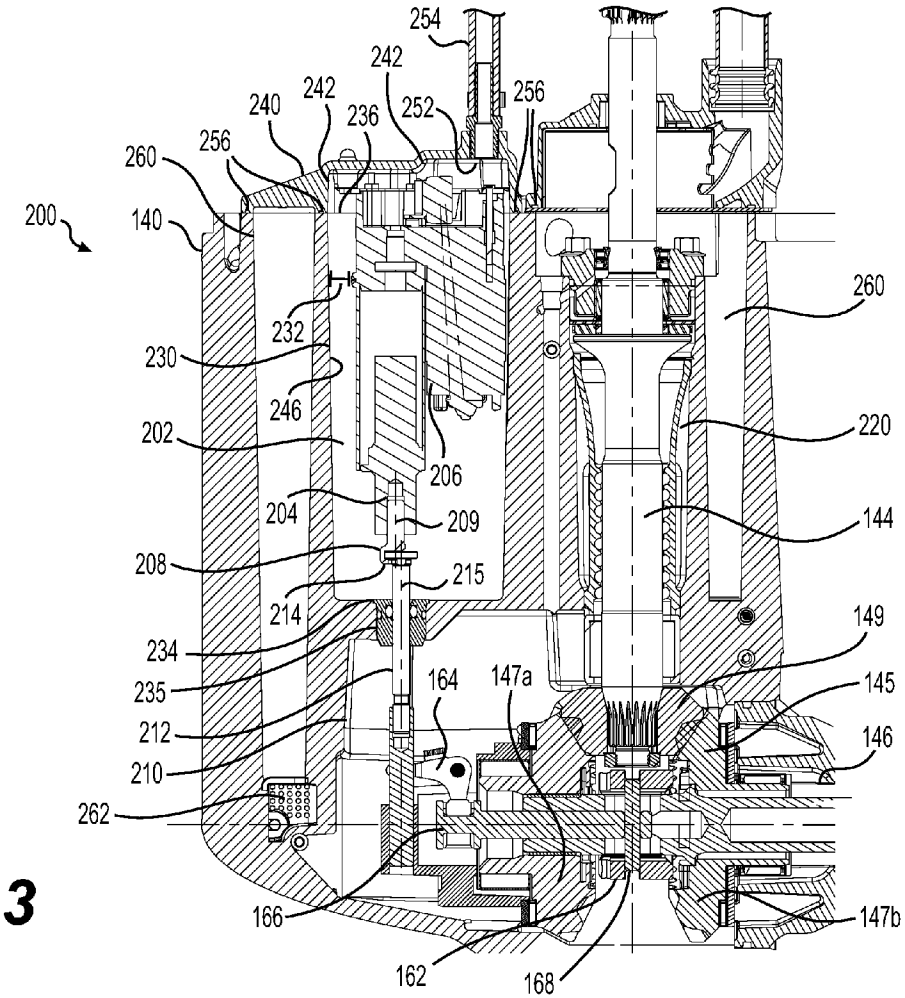
FIG. 3 is a vertical cross-sectional view of a portion of the gear case assembly of the marine outboard engine of FIG. 1.

The actuator chamber 230 extends downwards from an actuator opening 236 in the top surface of the gear case 140 as can be seen in FIGS. 2 and 3. The electric transmission actuator assembly 202 is inserted into and removed from the actuator chamber 230 through the actuator opening 236 during assembly and disassembly of the gear case assembly 200. A cap 240 is provided to close the actuator opening 236 and seal the actuator assembly 202 therewithin. In addition, the cap 240 has recesses 242 for receiving and/or engaging portions of the electric transmission actuator assembly 202 so as to fix the actuator assembly 202 in position. It is contemplated that the cap 240 could have projections, walls or other structures extending into the actuator chamber 230 to hold the actuator assembly 202 when the cap 240 is placed on the actuator chamber 230. It is also contemplated that the electric transmission actuator assembly actuator assembly 202 could be mounted fixedly or removably to the interior of the cap 240.

The cap 240 is removably secured to the gear case 140 with threaded bolts 244. The gear case 140 has complementary threaded holes (not shown in FIGS. 2 and 3) for receiving the bolts 244. It is contemplated that the cap 240 can be removably secured to the gear case by mechanisms such as pins, clips, clamps and the like instead of bolts and the cap 240 and the gear case 140 can be provided with the appropriate structure for achieving this.

The cap 240 has a cable opening 252 leading to a conduit 254 for carrying cables. Cables from the electric transmission actuator assembly 202 may be passed through the conduit 254 and cable opening 252 for electrical connections with the onboard controls (not shown). It is contemplated that the cap 240 could have built-in connectors on the interior and exterior surface for carrying power and electronic signals between elements inside the gear case and points onboard or other locations outside the gear case 140.

The gear case 140 also comprises a cooling water channel 260 adjacent to the actuator chamber 230. Water is taken into the channel 260 from an inlet 262 towards the front bottom of the gear case 140, fed around the driveshaft chamber 220 and passed up to the engine (not shown) after passing through the water channel 260. At least a part of the water channel 260 is bounded and sealed on the top surface of the gear case 140 by the cap 240. The cap 240 and openings such as the actuator opening 236 and the water channel 260 are sealed by a gasket 256 such as an O-ring and the like to prevent fluid leaking into the actuator chamber 230.

Figure 4B:
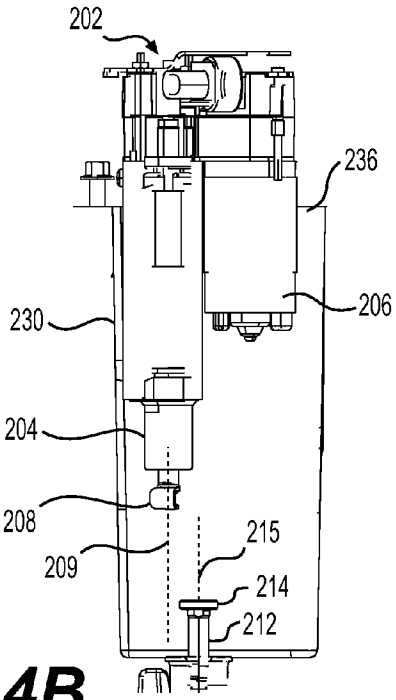
FIGS. 4A, 4B, 4C and 4D are vertical cross-sectional views of an actuator chamber the gear case of the marine outboard engine of FIG. 1 showing step by step the engagement of an actuator with an end of a shift rod.
Figure 4A:
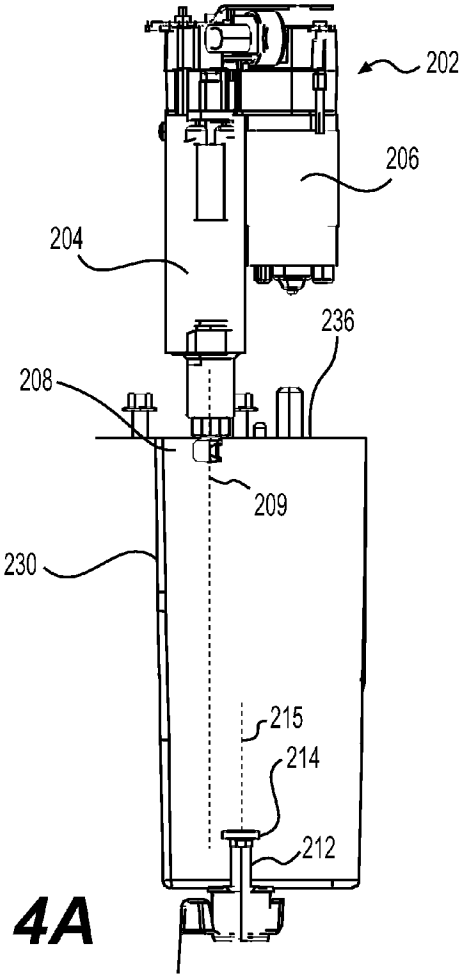
Figure 4D:
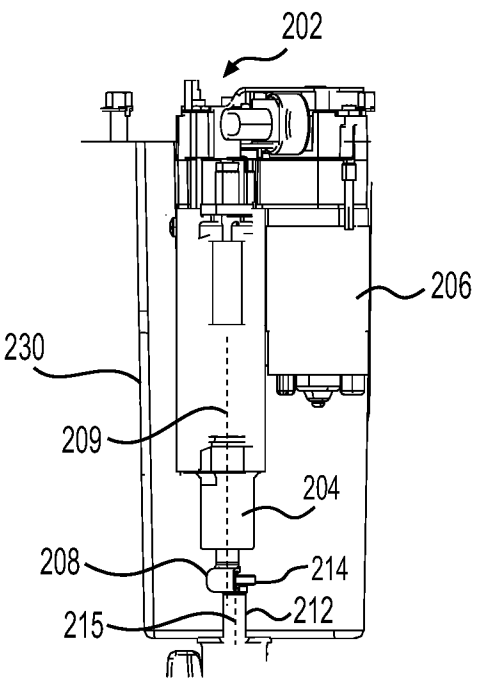
Figure 4C:
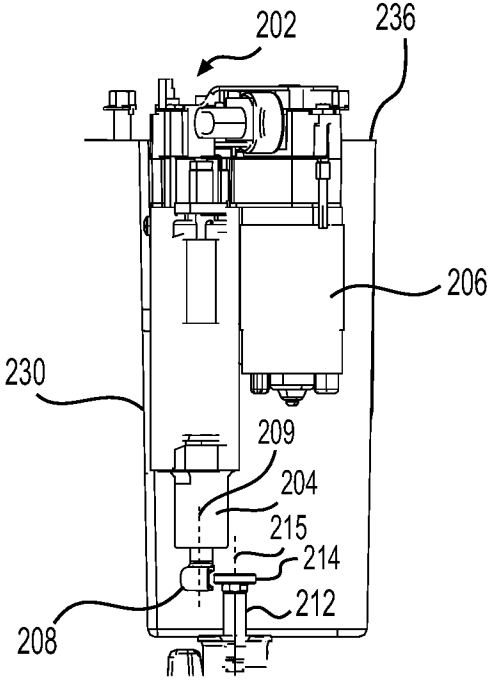

FIG. 4A-4D illustrate step-by-step a method of assembling the electric transmission actuator 202 into the actuator chamber 230 of the gear case 140 after the driveshaft 144, the propeller shaft 146 and the transmission 145 are already placed in their operating configurations in the gear case assembly 140. In FIG. 4A, the actuator assembly 202 is placed above the actuator opening 236 in the actuator chamber 230 such that the lateral distance between the front edge (left edge in the Figures) of the actuator assembly and the front wall 246 of the actuator chamber 230 is relatively small. The actuator assembly 202 is then inserted, as shown in FIG. 4B, longitudinally into the actuator chamber 230 through the actuator opening 236 such that there is a gap 232*r* between the rear edge of the actuator assembly 202 and the rear wall 248 of the actuator chamber 230. During insertion, the actuator end 208 is not aligned in the lateral direction with the end 214 of the shift rod 212. Insertion of the actuator assembly 202 into the actuator chamber 230 is complete when, as shown in FIG. 4C, the actuator end 208 is aligned with the end 214 of the shift rod 212 in the vertical direction but laterally offset in the horizontal direction. The actuator end 208 is thus aligned for engagement. The actuator assembly 202 is then translated towards the shift rod 212 to engage the actuator end 208 with the end 214 of the shift rod 212 as shown in FIG. 4D. The gap 232 is thus created between the front edge of the actuator assembly 202 and the front wall 246. The existence of the gap 232*r* between the actuator assembly 202 and the rear wall 248 of the actuator chamber 230 enables this translation of the actuator assembly 202 for the engagement step. The actuator opening 236 on the top surface of the gear case 140 is then closed with an actuator cap 240 and secured with threaded bolts thereby locking the actuator 204 in an engaged position with the shift rod 212 as well as closing the actuator chamber 230 and the water channel 260 as shown in FIG. 4D. It will be appreciated that some or all of these steps can be subsequently performed in the reverse order to disassemble the gear case assembly 140.

The dimension of the gap 232 between the actuator assembly 202 and a wall of the actuation chamber 230, at its minimum, is about two thirds of the dimension of the end 214 of the shift rod 212 to be engaged by the actuator 204. In general, the gap 232 should be large enough to allow translation of the actuator assembly 202 to engage the shift rod 212 after insertion of the actuator assembly 202 into the actuation chamber 230. In FIGS. 4A through 4D, the actuator assembly 202 is translated along a direction perpendicular to the actuation axis 209 in order to engage the actuator 204 with the shift rod 212, it is however contemplated that the translation could be in any direction at an angle to the actuation axis 209. It is also contemplated that the actuator assembly can be inserted into the actuation chamber at an angle to the actuation axis.

Figure 5:
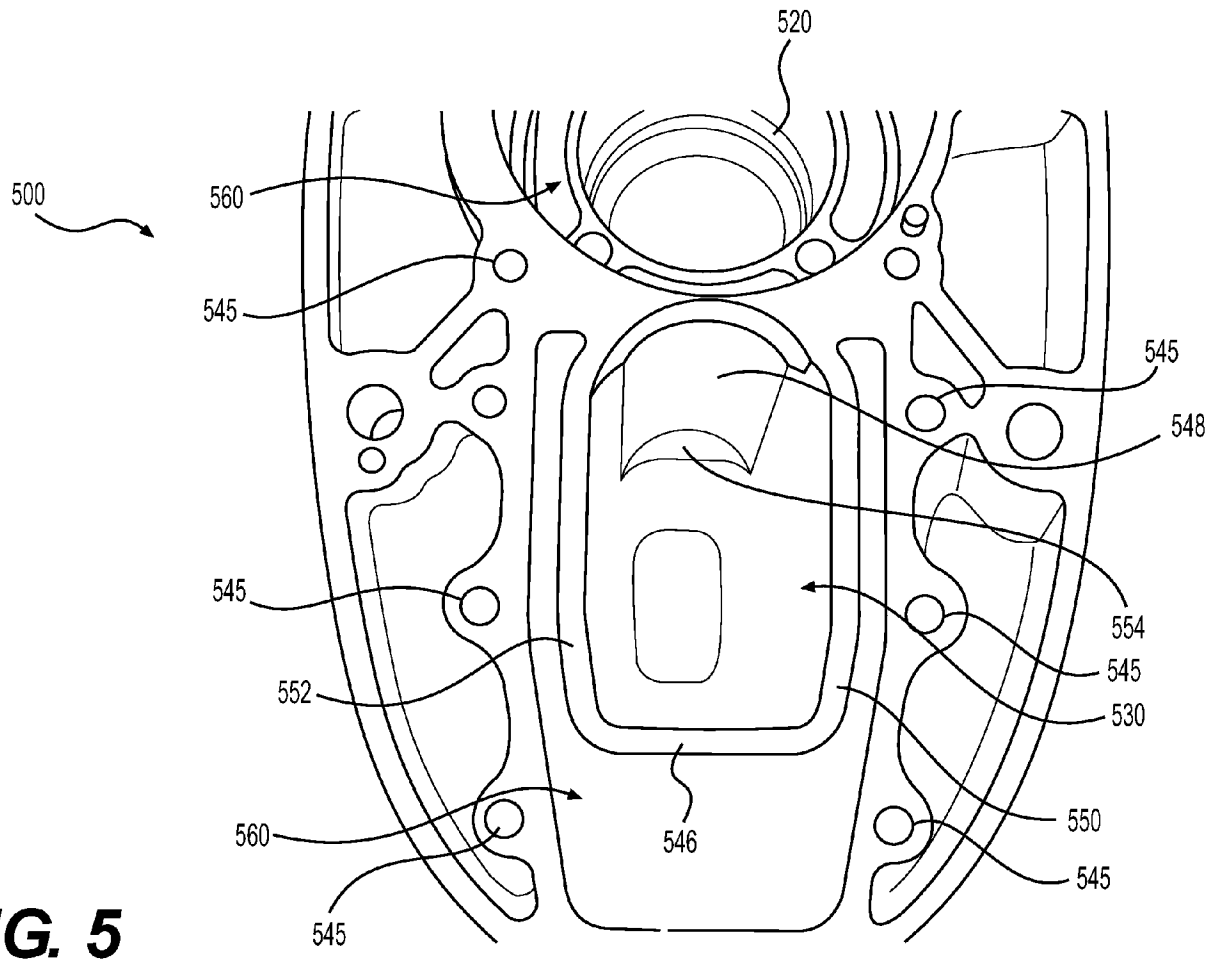
FIG. 5 is a top view of a portion of a gear case in accordance with another embodiment.

FIG. 5 shows a top perspective view of an actuator chamber 530 of a gear case 500 in accordance with another embodiment. In the horizontal plane or when viewed from the top, the actuator chamber 530 has a slightly curved rear wall 548 and generally planar walls on the front 546, left 550 and right 552 sides. The actuator chamber 530 is adjacent to the driveshaft chamber 520 on the rear side and the cooling water channel 560 on the front, left and right sides. Threaded holes 545 are provided to receive threaded bolts 244 for securing the actuator cap 240 to the gear case 500. A ledge or projection 554 extends horizontally from the rear wall 548 towards the center of the actuator chamber 530. This projection 554 serves to support the weight of the actuator assembly 202 in the actuator chamber 530. The projection 554 is thus located at a position along the rear wall 548 such that a bottom surface of the actuator assembly 202 abuts the top surface of the projection 554 and the actuator assembly 202 is supported thereon when the actuator end 208 is engaged with the end 214 of the shift rod 212.

It is contemplated that the projection 554 can extend out to a distance from the rear wall 548 towards the center of the actuation chamber 530 so that as the actuator assembly 202 is inserted into the actuator chamber 530 along or adjacent the front wall 546, the projection 554 makes contact with a bottom surface of the actuator assembly 202 thus constraining the actuator assembly 202 from being inserted any further into the chamber 530. The actuator assembly 202 can then be translated horizontally to engage the end 214 of the shift rod 212 while being supported on the projection 554. Alternately, the projection 554 may not extend as far out from the rear wall 548 and the actuator assembly 202 is supported on the projection after translation by some distance towards the rear wall 548 and the shift rod 212. The vertical position of the projection 554 along the rear wall 548 is adapted to ensure that when the actuator assembly is supported on the projection, the actuator end 208 of the actuator 204 is in a position vertically aligned with the end 214 of the shift rod 212.

It is contemplated that the shape of the projection 554 can be adapted according to the bottom surfaces of the actuator assembly 202. It is also contemplated that there can be multiple projections on the actuator chamber walls, for example to support different parts of the actuator assembly.

FIGS. 6A to 6E show close-up perspective views of various embodiments of the female actuator end 208 and the corresponding male end 214 of the shift rod 212. The male end 214 of the shift rod 212 is a disc 282 with a horizontal surface perpendicular to the vertically disposed shift rod 212. The corresponding female actuator end 208 comprises a slot 284 adapted to receive the disc 282 and a part of the shift rod 212.

Figure 6C:
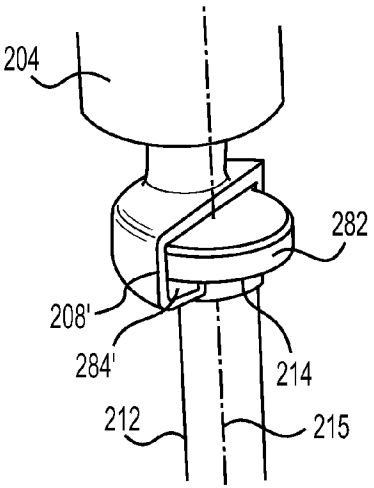
FIG. 6C illustrates an alternative embodiment of the shift rod.
Figure 6B:
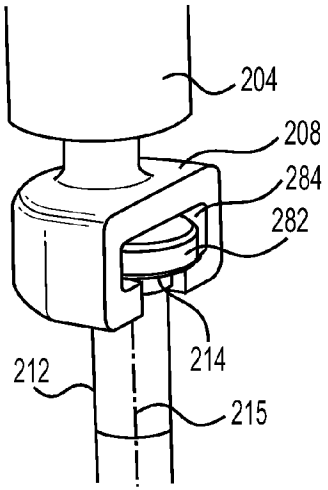
FIGS. 6A and 6B are close-up perspective views of the actuator engaging the end of the shift rod.
Figure 6A:
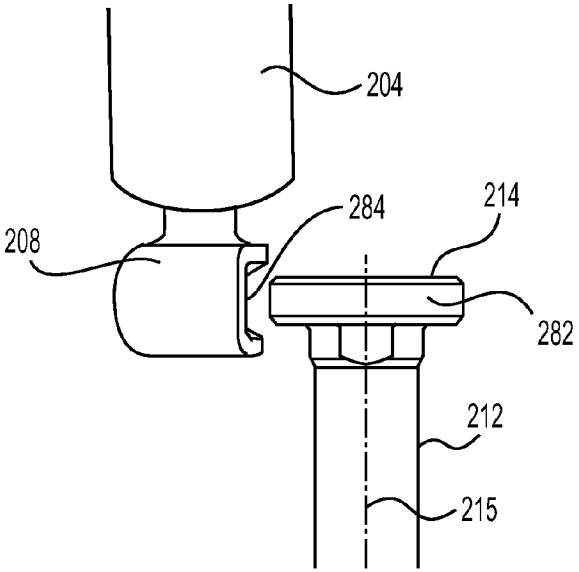

In the embodiments of the male end 214 illustrated in FIGS. 6A to 6C, the disc 282 is a circular disc 282 (i.e. the disc 282 has a circular cross-section when cut along a plane perpendicular to the shift rod axis 215).

In the embodiment illustrated in FIGS. 6A and 6B, the slot 284 encompasses more than half of the disc 282. In the embodiment illustrated in FIG. 6C, the female end 208' in which the slot 284' encompasses half of the disc 282 of the male end 214.

Figure 6E:
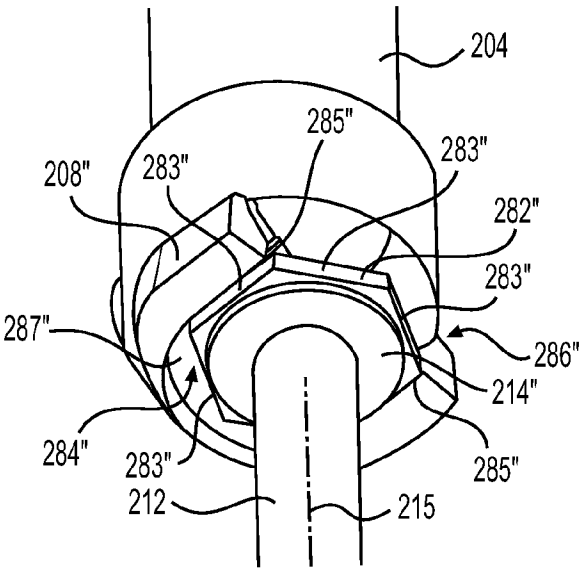
FIGS. 6D and 6E are close-up perspective views, of another embodiment of a shift rod and an actuator end.
Figure 6D:
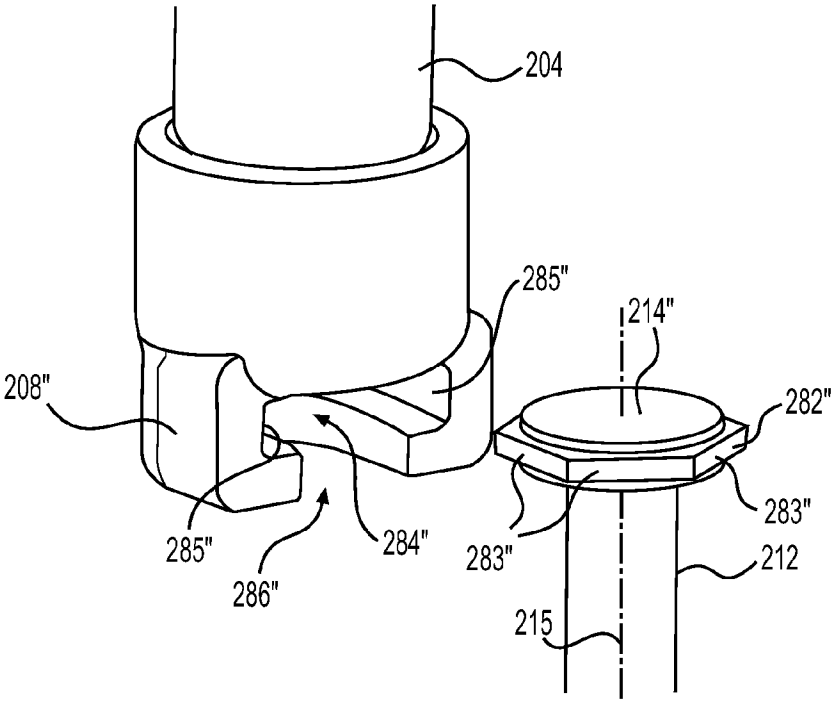

FIGS. 6D and 6E show another embodiment of a female actuator end 208" and a corresponding male end 214" of a shift rod 212 that are non-rotatably engaged. The male end 214" of the shift rod 212 is in the form of a hexagonal disc 282". The disc 282" has a hexagonal cross-section when cut along a plane perpendicular to the shift rod axis 215 with six surfaces 283" extending parallel to the shift rod axis 215. Each surface 283" also extends parallel to the surface 283" disposed on an opposite side of the shift rod axis 215. The female actuator end 208" has a slot 284" defined by a slot opening 286" and walls 285", 287" extending parallel to the shift rod 212. The walls 285", adjacent to the slot opening 286", are parallel to one another. The walls 285" are connected together by the wall 287" extending opposite the slot opening 286". The disc 282" is received non-rotatably in the slot 284" with two parallel surfaces 283" of the disc 282" abutting the parallel walls 285" of the slot 284" so as to prevent rotation of the disc 282" in the slot 284" about the shift rod axis 215. The portion of the wall 287" of the slot 284" opposite the slot opening 286" is curved as can be seen in FIG. 6E, but it is contemplated that the wall 287" opposite the opening 286" could also be angled to match the surfaces 283" of the hexagonal disc 282". The slot 284" encompasses more than half of the disc 282" but it is contemplated that the slot 284" could encompass a smaller portion of the disc 282" than as shown, as long as the portion of the disc 282" encompassed by the slot 284" includes at least a portion of each of two opposite and parallel surfaces 283" of the disc 282".

It is contemplated that the male end 214 could also be in the form of a circular disc modified on opposite sides to have two parallel surfaces, similar to the shape of the slot 284 of FIGS. 6D and 6E. The shapes of the disc 282 and slot 284 are not limited to those of the illustrated embodiments. It is contemplated that the complementary disc 282 and slot 284 could have other corresponding shapes that can be engaged to prevent rotation therebetween, for example, the disc and slot could be elliptical, rectangular or triangular.

It is contemplated that the actuator end 208 could be the female end and the end 214 of the shift rod 212 could be the corresponding male end. It is contemplated that the actuator end 208 and the end 214 of the shift rod 212 can form any complementary male-female combinations that could be mutually engaged by translation. It is also contemplated that the actuator end 208 and the end 214 of the shift rod 212 could be comprised of male-female structures that can be placed in mutual engagement by rotation relative to each other, for example, the male-female ends could be formed of cylindrical structures that could be screwed to each other, or the male end could be T-shaped and could be locked into a complementary slot with a T-shaped cross-section by a 90 degree rotation around the actuation axis. In this case, it is contemplated that the gap between the actuator assembly 202 and a wall of the actuator chamber 230 in a direction perpendicular to the actuator axis 209 would be adapted to accommodate rotation of the actuator assembly 202 about the actuator axis 209, for example, it might have a dimension that is equal to or a fraction of the dimension of the electric motor housing 206 adjacent to the actuator 204.

As mentioned previously, it is also contemplated that the actuator 204 can be a rotary actuator instead of a linear actuator. The male/female ends actuator 204 and shaft rod 212 for the case of a rotary actuator would comprise mating gear or teeth or corresponding projections and recesses for mutual engagement.

The term "end" as used herein with respect to "actuator end 208" and "end of the shift rod 214" is not intended to refer only to an extremity, an edge or a terminal surface. The term "end" is intended to encompass the structures at the end portions of the actuator 204 and shaft rod 212 that are in mutual engagement, for example, this may include a portion of a shaft of the actuator 204 or shift rod 212 if the shaft or some structure along the shaft is in engagement with some part of the other of the actuator 204 and the shift rod 212.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A gear case assembly for a marine outboard engine comprising:

a gear case;

a driveshaft, a part of the driveshaft being disposed within the gear case;

a propeller shaft disposed at least in part within the gear case and at an angle to the driveshaft;

a transmission having forward and reverse gears and a shift rod, the transmission being operatively connected to the propeller shaft, the lower section of the driveshaft selectively driving the propeller shaft via the transmission, the shift rod being selectively actuated for the selective driving of the propeller shaft; and an electric transmission actuator assembly selectively actuating the shift rod, the electric transmission actuator assembly having an actuation axis and an actuator end, the actuator end engaging an end of the shift rod;

the gear case having an actuator chamber housing at least part of the electric transmission actuator assembly; and a gap defined between the electric transmission actuator assembly and a wall of the actuator chamber, the gap extending in a direction perpendicular to the actuation axis, the gap being sized and shaped to permit a translation of the electric transmission actuator assembly in the direction perpendicular to the actuation axis away from the shift rod and thereby enable the disengagement of the actuator end from the end of the shift rod.

2. The gear case assembly of claim 1, a dimension of the gap being at least a third of a dimension of the end of the shift rod in the direction perpendicular to the actuation axis.

3. The gear case assembly of claim 1, wherein the gear case has a transmission chamber housing at least a part of the propeller shaft and the transmission.

4. The gear case assembly of claim 1, wherein the gear case has a driveshaft chamber housing the part of the driveshaft.

5. The gear case assembly of claim 3, wherein the shift rod extends into the actuator chamber via a passage extending between the actuation chamber and the transmission chamber.

6. The gear case assembly of claim 5, wherein the passage seals around the shift rod as it extends therethrough.

7. The gear case assembly of claim 1, wherein the actuator chamber has a projection extending from a wall of the actuator chamber towards the actuation axis; and wherein a surface of the electric transmission actuator assembly abuts a surface of the projection, the projection being disposed between the surface of the electric transmission actuator assembly and the transmission chamber.

8. The gear case assembly of claim 1, further comprising an actuator cap closing an open end of the actuator chamber.

9. The gear case assembly of claim 8, wherein the actuator cap engages the electric transmission actuator assembly and thereby fixes the position of the electric transmission actuator assembly within the actuator chamber.

10. The gear case assembly of claim 1, wherein the actuation axis is parallel to the driveshaft.

11. The gear case assembly of claim 1, wherein the actuator is a linear actuator.

12. The gear case assembly of claim 1, wherein one of the actuator end and an end of the shift rod has a male end and an other of the actuator end and the end of the shift rod has a female end in mutual engagement.

13. The gear case assembly of claim 12, wherein the male end comprises a disc and the female end comprises a slot, at least a portion of the disc being received in the slot, the portion of the disc being disposed between portions of the female end at least in a direction parallel to the actuation axis.

14. The gear case assembly of claim 13, wherein:

the disc is a circular disc having a circular cross-section in the direction parallel to the shift rod.

15. The gear case assembly of claim 13, wherein:

the disc comprises two surfaces extending parallel to one another and parallel to the shift rod; and the slot comprises two walls extending parallel to one another, the two parallel walls of the slot engaging the two parallel surfaces of the disc received therein to thereby prevent rotation of the disc about an axis parallel to the shift rod.

16. The gear case assembly of claim 1, wherein the electric transmission actuator assembly comprises an actuator and an electric motor.

17. A marine outboard engine, comprising:

a cowling;

an engine disposed in the cowling;

a driveshaft disposed in the cowling, the driveshaft having at least an upper section and a lower section, the upper section of the driveshaft being operatively connected to the engine;

a midsection having a first end and a second end, the first end of the midsection being connected to the engine;

a gear case operatively connected to the second end of the midsection;

a propeller shaft disposed at an angle to the driveshaft;

a transmission having forward and reverse gears and a shift rod, the transmission operatively connected to the propeller shaft, the lower section of the drive shaft selectively driving the propeller shaft via the transmission, the shift rod being selectively actuated for the selective driving of the propeller shaft;

an electric transmission actuator assembly selectively actuating the shift rod, the electric transmission actuator assembly having an actuation axis and an actuator end, the actuator end engaging an end of the shift rod; and a bladed rotor connected to the propeller shaft;

at least a part of the propeller shaft and the driveshaft being disposed within the gear case;

the gear case having an actuator chamber housing at least part of the electric transmission actuator assembly; and a gap defined between the electric transmission actuator assembly and a wall of the actuator chamber, the gap extending in a direction perpendicular to the actuation axis to permit a translation of the electric transmission actuator assembly in the direction perpendicular to the actuation axis away from the shift rod and thereby enable the disengagement of the actuator end from the end of the shift rod.

18. A method of assembling an electric transmission actuator assembly in a gear case assembly, the gear case assembly comprising a gear case having an actuator chamber for housing the electric transmission actuator assembly, a transmission and a transmission chamber for housing at least a part of the transmission, the transmission comprising a shift rod extending from the transmission chamber into the actuator chamber; the electrical transmission actuator assembly comprising an actuator end;

the method comprising:

inserting the electrical transmission actuator assembly into the actuator chamber along a first direction until the actuator end is aligned with an end of the shift rod in the first direction and the actuator end is spaced apart from the end of the shift rod in a second direction perpendicular to the first direction; and translating the electric transmission actuator assembly in the second direction towards the end of the shift rod so as to engage the actuator end with the end of the shift rod.

19. The method of claim 18, further comprising translating the electric transmission actuator assembly towards the shift rod until a surface of the electric transmission actuator assembly rests upon a surface of a projection, the projection extending from a wall of the actuator chamber in a direction perpendicular to the first direction thereby supporting the electric transmission actuator assembly on the projection and aligning the actuator end with the end of the shift rod in the first direction.

20. The method of claim 18, further comprising:

placing an actuator cap to the gear case after engaging the actuator end with the end of the shift rod to close an opening of the actuator chamber, the opening being the opening through which the electric transmission actuator assembly is inserted into the actuator chamber; and securing the actuator cap to the gear case.

21. The method of claim 20, wherein the actuator cap engages the electric transmission actuator assembly and the step of securing the actuator cap to the gear case fixes the position of the electric transmission actuator assembly within the actuator chamber.

* * * * *